US010954656B2

(12) United States Patent
Song et al.

(10) Patent No.: US 10,954,656 B2
(45) Date of Patent: Mar. 23, 2021

(54) BUCKET TOOTH OF EXCAVATOR

(71) Applicant: SUNGBO INDUSTRIAL CO., LTD., Incheon (KR)

(72) Inventors: Keun Chul Song, Seoul (KR); Dae Hyun Ryu, Incheon (KR); Chang Woo Lim, Incheon (KR); Hwa Yong Shin, Incheon (KR); Ryun Han Lee, Incheon (KR)

(73) Assignee: SUNGBO INDUSTRIAL CO., LTD., Incheon (KR)

( * ) Notice: Subject to any disclaimer, the term of this patent is extended or adjusted under 35 U.S.C. 154(b) by 244 days.

(21) Appl. No.: 16/157,606

(22) Filed: Oct. 11, 2018

(65) Prior Publication Data

US 2019/0203445 A1 Jul. 4, 2019

(30) Foreign Application Priority Data

Dec. 29, 2017 (KR) ..... 10-2017-0183885
May 14, 2018 (KR) ..... 10-2018-0054736

(51) Int. Cl.
*E02F 9/28* (2006.01)

(52) U.S. Cl.
CPC ..... *E02F 9/2833* (2013.01); *E02F 9/2808* (2013.01); *E02F 9/2825* (2013.01)

(58) Field of Classification Search
CPC ..... E02F 9/2833; E02F 9/2841; E02F 9/2808; E02F 9/2825
See application file for complete search history.

(56) References Cited

U.S. PATENT DOCUMENTS 5,937,551 A 8/1999 Moehnke et al.
5,966,849 A * 10/1999 Moehnke ..... E02F 3/58 172/719
5,987,787 A 11/1999 Mack
2003/0070330 A1* 4/2003 Olds ..... E02F 9/2825 37/456
2004/0148821 A1* 8/2004 Keech ..... E02F 9/2841 37/452
2004/0216336 A1 11/2004 Briscoe
(Continued)

FOREIGN PATENT DOCUMENTS

EP 3040485 A2 7/2016
JP S55-008715 U 1/1980
(Continued)

*Primary Examiner* — Jessica H Lutz
(74) *Attorney, Agent, or Firm* — Novick, Kim & Lee, PLLC; Jae Youn Kim

(57) ABSTRACT

A tooth for a bucket of an excavator includes a point body having a hollow insertion recess and having a pair of coupling holes provided at positions facing each other on the opposite sides, and a pair of connection units respectively inserted into the pair of coupling holes and having a unit body and a protrusion protruding from the unit body, wherein the point body includes: a guide portion positioned in each of the coupling holes and guiding a rotational operation of the protrusion, a fixing portion fixing a position of each of the inserted connection unit, a buffer portion positioned between the fixing portion and an inner surface of the point body and surrounding the fixing portion, and a support where the fixing portion and the buffer portion are positioned.

12 Claims, 13 Drawing Sheets

(56) References Cited

U.S. PATENT DOCUMENTS

| | | | | |
|---|---|---|---|---|
| 2007/0209189 | A1* | 9/2007 | Lopez Almendros | E02F 9/2841 29/525.01 |
| 2008/0028644 | A1* | 2/2008 | Lopez Almendros | E02F 9/2825 37/457 |
| 2010/0162594 | A1 | 7/2010 | Bierwith | |
| 2010/0236108 | A1* | 9/2010 | Ruvang | E02F 9/2825 37/452 |
| 2013/0333254 | A1 | 12/2013 | Wallis et al. | |
| 2014/0259807 | A1* | 9/2014 | Jeske | E02F 9/2891 37/455 |
| 2014/0352181 | A1 | 12/2014 | Campomanes | |
| 2018/0171602 | A1* | 6/2018 | Quarfordt | E02F 9/2841 |

FOREIGN PATENT DOCUMENTS

| | | | |
|---|---|---|---|
| JP | S62-050263 | U | 3/1987 |
| JP | 2012-521508 | A | 9/2012 |
| JP | 2014-52098 | A | 3/2014 |
| KR | 10-2006-0011366 | A | 2/2006 |
| KR | 10-2011-0134457 | A | 12/2011 |
| KR | 10-2015-0137346 | A | 12/2015 |

* cited by examiner

BUCKET TOOTH OF EXCAVATOR

CROSS-REFERENCE TO RELATED APPLICATIONS

The present invention claims priority to Korean patent application Nos.

10-2017-0183885 filed on Dec. 29, 2017, and 10-2018-0054736 filed on May 14, 2018, the disclosure of which is hereby incorporated by reference.

BACKGROUND OF THE INVENTION

Field of the Invention

The present disclosure relates to a tooth for a bucket of an excavator.

Description of the Related Art

A digging apparatus such as an excavator used in public works or mines is used to dig earth and stone and pile up the dug earth or stone to other locations or a cargo box of a vehicle.

Such a digging apparatus generally has a bucket coupled to a mechanical arm and used to dig and carry earth or stone.

The end of the bucket is equipped with a plurality of tooth points which are used to dig and crush earth or stone.

Here, the tooth points are connected to the bucket via a tooth adapter connected to the bucket, and thus, the plurality of tooth points are substantially connected to the tooth adapter.

When a digging operation is performed through such a digging apparatus, a direct digging operation such as digging an excavation spot, moving soil and gravel, and the like, is performed by the tooth points, and thus, the tooth points wear with the lapse of time.

Therefore, wear of the tooth points exceeds a set value (or a set state), it is necessary to replace the tooth points to ensure a smooth digging operation and protect the excavator.

SUMMARY

An aspect of the present disclosure is to increase a coupling force between a tooth adapter and tooth points in a digging apparatus.

Another aspect of the present disclosure to allow a tooth adapter and tooth points to be easily released to facilitate a replacing operation of the tooth points.

According to an aspect of the present disclosure, there is provided a tooth for a bucket of an excavator, including: a point body having a hollow insertion recess and having a pair of coupling holes provided at positions facing each other on the opposite sides; and a pair of connection units respectively inserted into the pair of coupling holes and having a unit body and a protrusion protruding from the unit body, wherein the point body includes: a guide portion positioned in each of the coupling holes and guiding a rotational operation of the protrusion; a fixing portion fixing a position of each of the inserted connection unit; a buffer portion positioned between the fixing portion and an inner surface of the point body and surrounding the fixing portion; and a support where the fixing portion and the buffer portion are positioned.

The guide portion may have the same thickness, regardless of position, or may be increased in thickness toward the support.

The fixing portion may include a portion protruding to the outside of the support.

The buffer portion may be formed of an elastic material.

The fixing portion may have a rectangular parallelepiped shape, the buffer portion may have a shape of "⊏", and the fixing portion may be surrounded by the buffer portion.

Each connection unit may include an upper surface having a circular planar shape, a side surface having first to third flat surface portions positioned below the upper surface and a curved portion positioned between two adjacent flat surface portions and having a protrusion, and a lower surface connected to the side surface.

The side surface may further include a circular portion between the upper surface and the second and third flat surface portions.

The first to third flat surface portions may be cut surfaces cut from the circular portion to the lower surface.

Some of the first to third flat surface portions may be cut surfaces cut from the circular portion to the lower surface and the other remaining flat surface portion may be a cut surface cut from the circular portion to a portion before the lower surface.

When each connection unit is inserted into each coupling hole, one of the first to third flat surface portions may come into contact with the fixing portion, and when rotation of the connection unit inserted into the coupling hole is completed, the other of the first to third flat surface portions may come into contact with the fixing portion.

The pair of connection units respectively inserted into the corresponding coupling holes may be spaced apart from each other in the insertion recess.

An upper surface of each connection unit may include a polygonal recess.

According to the features of the present disclosure, since the tooth point is coupled to the tooth adapter using the pair of connection units, the coupling operation of the tooth point may be easily performed, compared with the case of using a single connection unit, and since the amount of a material required for manufacturing the connection units is reduced, manufacturing cost may be reduced.

Also, since the guide portion for guiding the protrusion of the connection unit has the sloped surface different in thickness according to positions, an operation of the connection units for a coupling or releasing operation of the tooth point may be facilitated.

Further, since the tooth point has the buffer portion surrounding the fixing portion, when the connection unit is inserted, the fixing portion protruding out of the support portion is moved to facilitate insertion of the connection units, and when the connection units are completely inserted, a coupling force of the connection units in the coupling holes are increased by elasticity of the buffer portion, and thus, a phenomenon in which the connection units are automatically released may be significantly reduced.

BRIEF DESCRIPTION OF THE DRAWINGS

The above and other aspects, features and other advantages of the present disclosure will be more clearly understood from the following detailed description taken in conjunction with the accompanying drawings, in which:

FIGS. 10A to 10C are cross-sectional views of a coupling hole when a connection unit is inserted into the coupling hole in a bucket tooth of an excavator according to the embodiment of the present disclosure, in which FIG. 10A is a view illustrating a state immediately after the connection unit is inserted, FIG. 10B is a view illustrating the connection unit in the course of rotating in a corresponding direction to perform a fastening operation, and FIG. 10C is a view illustrating a state after the connection unit is rotated in the corresponding direction to perform the fastening operation.

DETAILED DESCRIPTION

Figure 1:
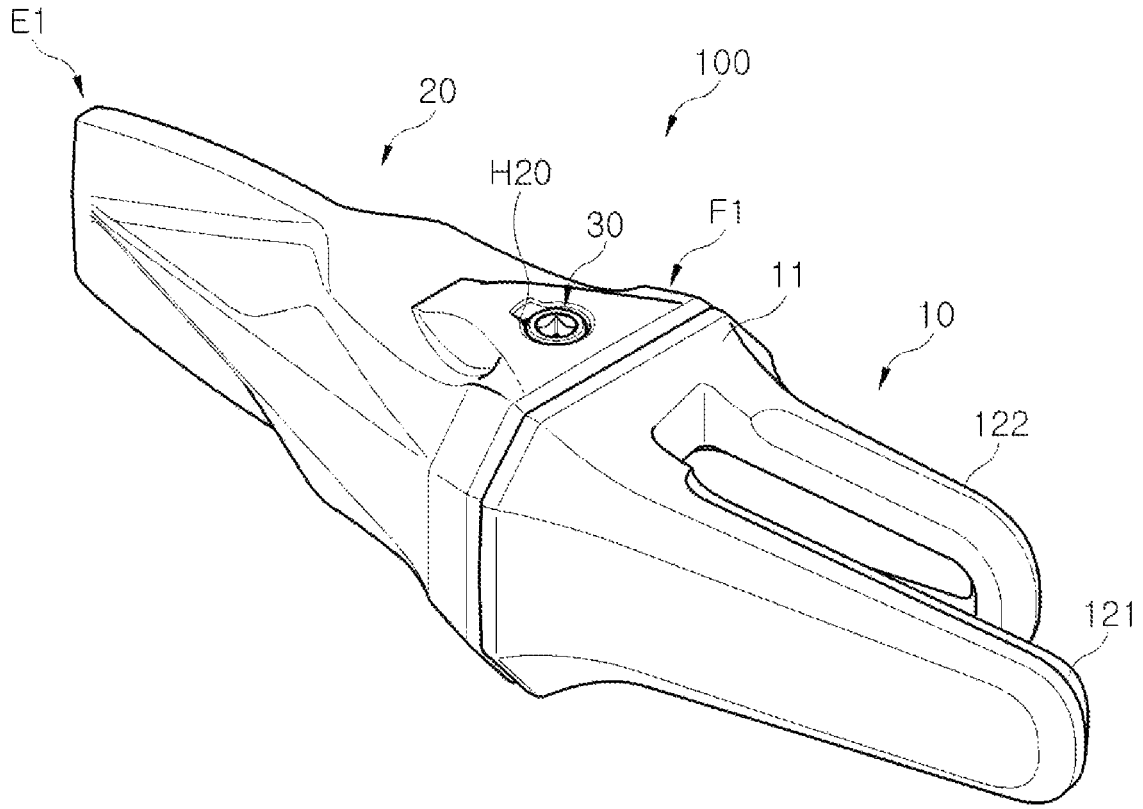
FIG. 1 is a perspective view of a bucket for a bucket of an excavator according to an embodiment of the present disclosure.

Hereinafter, embodiments of the present invention will be described in detail with reference to the accompanying drawings. In describing the present invention, if it is determined that a detailed description of known functions and components associated with the present invention unnecessarily obscure the gist of the present invention, the detailed description thereof will be omitted. The terms used henceforth are used to appropriately express the embodiments of the present invention and may be altered according to a person of a related field or conventional practice. Therefore, the terms should be defined on the basis of the entire content of this specification.

Technical terms used in the present specification are used only in order to describe specific exemplary embodiments rather than limiting the present invention. The terms of a singular form may include plural forms unless referred to the contrary. It will be further understood that the terms "comprise" and/or "comprising," when used herein, specify the presence of stated features, integers, steps, operations, elements, and/or components, but do not preclude the presence or addition of one or more other features, regions, integers, steps, operations, elements, components, and/or groups thereof.

Hereinafter, a tooth for a bucket (or a bucket tooth) of an excavator according to an embodiment of the present disclosure will be described with reference to the accompanying drawings.

Referring to FIGS. 1 to 6, a bucket tooth 100 of an excavator of the present example includes a tooth adapter 10 coupled to a bucket (not shown) of an excavator, a tooth point 2 connected to the tooth adapter 100, and a connection unit 30.

The tooth adapter 10 includes an adapter body 11, first and second mounting portions 121 and 122 extending backwards from the adapter body 11, and an insertion portion 13 extending forwards from the adapter body 11.

In this disclosure, in relation to the tooth adapter 10 and the tooth point 20 illustrated in FIG. 1, the tooth adapter 10 side will be referred to as a front side and the tooth adapter 10 side will be referred to as a rear side.

The adapter body 11 has a substantially rectangular planar shape.

The first and second mounting portions 121 and 122 are fixedly coupled to a bucket of the excavator, are positioned at corresponding portions on the mutually opposite sides of a rear surface as a corresponding surface of the adapter body 11, e.g., left and right portions of the adapter body 11, and are spaced apart from each other.

Figure 2:
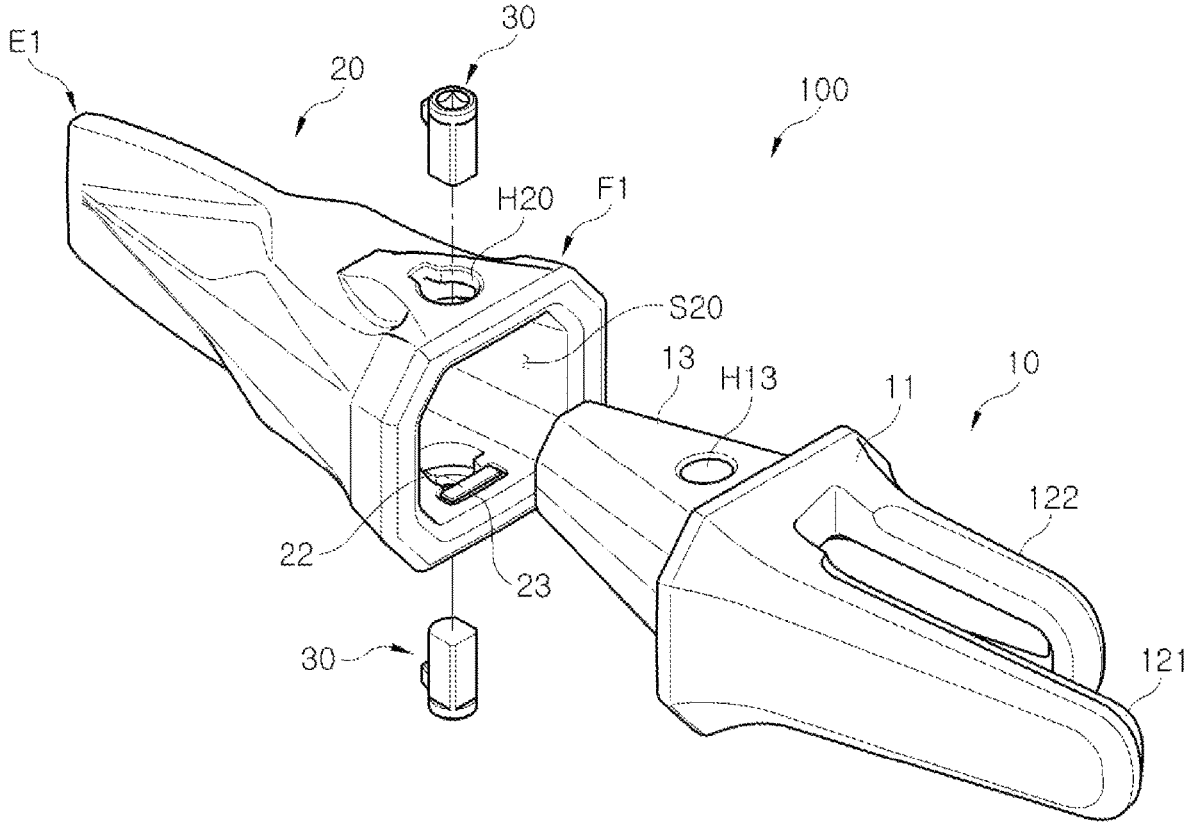
FIG. 2 is an exploded perspective view of a tooth for a bucket (or a bucket tooth) of the excavator illustrated in FIG. 1.
Figure 3:
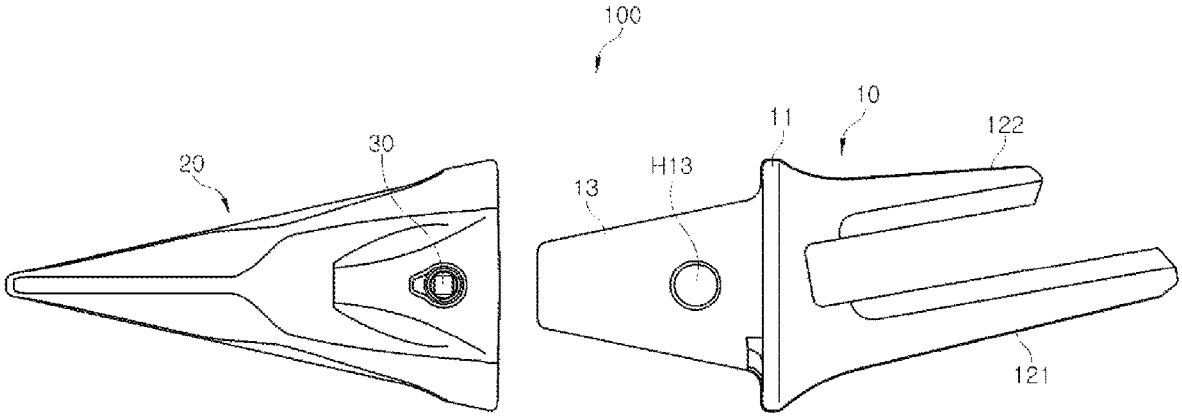
FIG. 3 is a plan view of the bucket tooth of the excavator illustrated in FIG. 2.

Referring to FIGS. 1 and 2, the first mounting portion 121 protrudes from the left portion of the rear surface of the adapter body 11 and extends backwards, and the second mounting portion 122 protrudes from the right portion of the rear surface of the adapter body 11 and extends backwards.

The first and second mounting portions 121 and 122 are configured to have a shape of a protrusion reduced in size in a cross-section thereof toward the rear side.

The insertion portion 13, which is coupled to the tooth point 20, has a shape of a protrusion protruding forwards from a front surface of the adapter body 11 and has a cross-section reduced in the extending direction.

Here, the cross-section of the insertion portion 13 has a polygonal shape, and an upper surface and a lower surface thereof are flat.

The insertion portion 13 has a through hole H13 penetrating through the insertion portion 13 in a thickness direction Z of the insertion portion 13. Here, the through hole H13 is positioned adjacent to the adapter body 11 and completely penetrates through the insertion portion 13 from the upper surface to the lower surface of the insertion portion 13, or vice versa.

Accordingly, the first and second mounting portions 121 and 122 and the insertion portion 13 extend by corresponding lengths, respectively, in the opposite directions based on the adapter body 11.

The tooth point 20, which is coupled with the tooth adapter 10 to dig an excavation spot, includes a point body 201 having a pair of coupling holes H20 positioned to correspond to each other on two surfaces (e.g., the upper and lower surfaces) corresponding to each other on the opposite sides, a guide portion 21 guiding a rotational operation of a protrusion 32 of the inserted connection unit 30, a fixing portion 22 which comes into contact with one (e.g., a first flat surface portion 3131) of first to third flat surface portions 3131 to 3133 of the connection unit 30 when the connection unit 30 is inserted and which comes into contact with one (e.g., the second flat surface portion 3132) of the first to third flat surface portions 3131 to 3133 when a rotational operation of the connection unit 30 is completed, a buffer portion 23 positioned between the fixing portion 22 and the tooth point 20, and a support portion 24 supporting the fixing portion 22 and the buffer portion 23.

Figure 4:
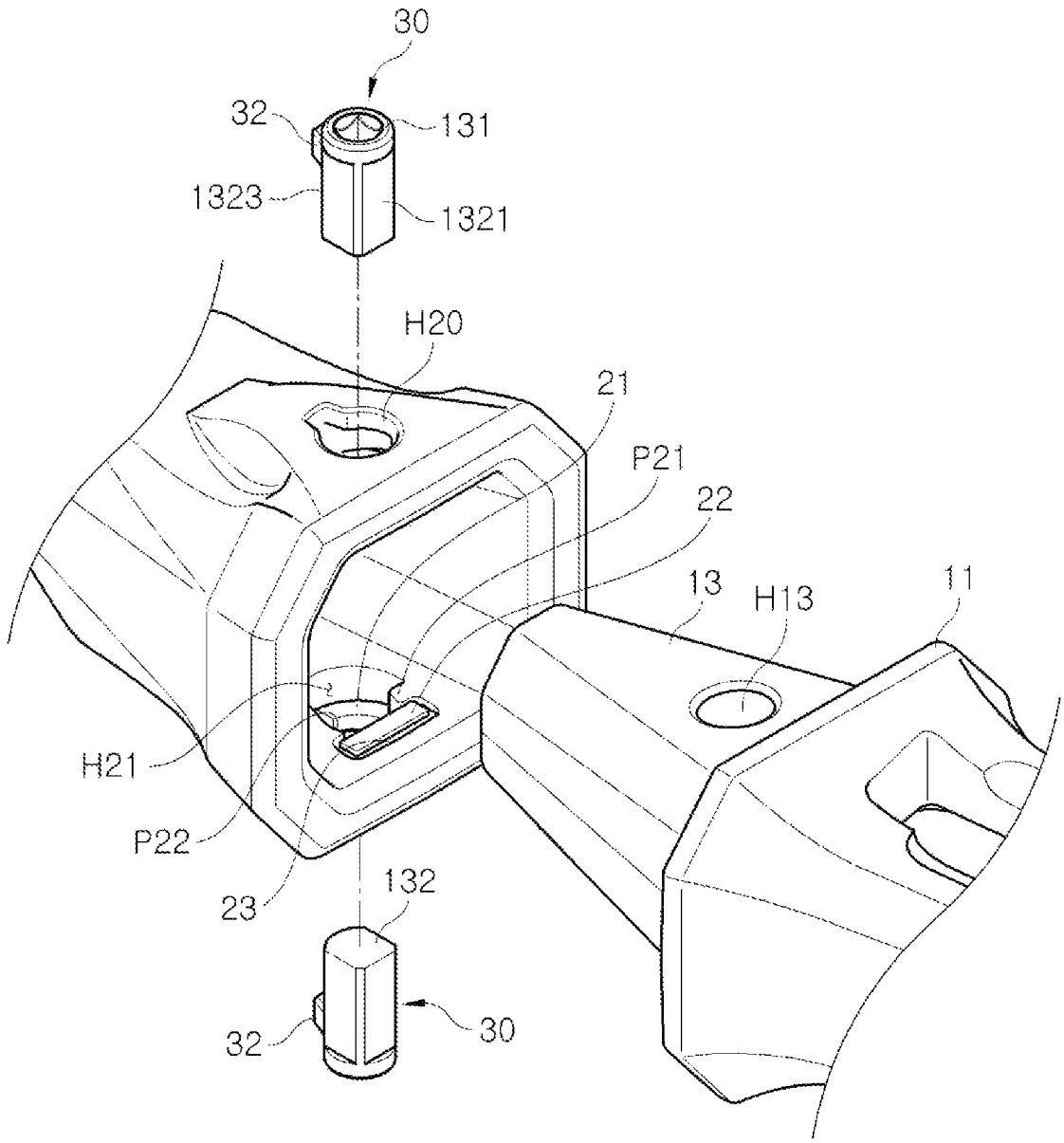
FIGS. 4 and 5 are a partial exploded perspective view of the bucket tooth of the excavator illustrated in FIG. 1, respectively, viewed in different directions.
Figure 5:
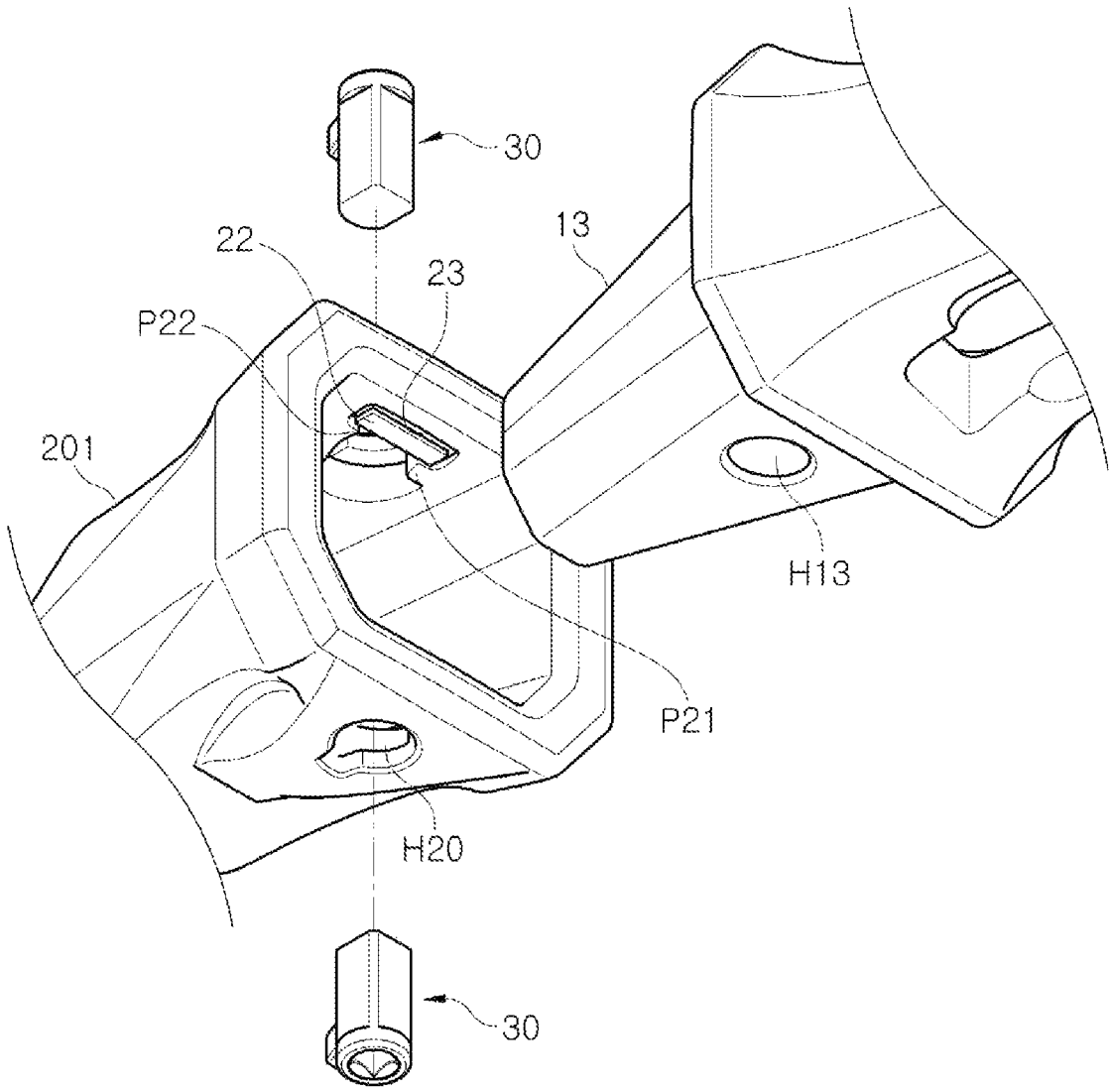

As illustrated in FIGS. 4 and 5, the guide portion 21, the fixing portion 22, the buffer portion 23, and the support portion 24 are positioned on an inner surface of the point body 201 inside the coupling hole H20 (i.e., the surface onto which the coupling hole H20 abuts).

The point body 201 further includes an insertion recess (or an insertion hole) S20 as an empty space, into which the insertion portion 13 of the tooth adapter 10 is inserted, at a central portion thereof in addition to the pair of coupling holes H20. The pair of insertion holes H20 communicate with the insertion recess S20.

Since the insertion recess S20 is a space into which the insertion portion 13 of the tooth adapter 10 is inserted as described above, a shape and a length of the insertion recess S20 are determined depending on an appearance of the insertion portion 13 and a protruding length of the insertion portion 13. Thus, in the insertion recess S20, a diameter of the space thereof is reduced from a front end F1 toward a rear end E1 of the tooth point 20, like the shape of the insertion portion 13.

When the insertion portion 13 of the tooth adapter 10 is inserted into the insertion hole S20 of the tooth point 20, a rear surface of the front end of the tooth point 20 adjacent to the tooth adapter 10 comes into contact with a front surface as a corresponding surface of the adapter body 11 of the tooth adapter 10. Thus, a cross-sectional shape and a size of the rear surface of the front end adjacent to the tooth adapter 10 are determined on the basis of a shape and a size of the front surface of the adapter body 110.

The pair of coupling holes H20 located on the opposite sides are holes into which the connection unit 30 is inserted.

The guide portion 21 has a thickness T21 and a width W21 determined according to the body 201 of the tooth point 20 taken in a direction from an upper surface or a lower surface of the body 201 of the tooth point 20 toward the insertion recess S20.

In this example, the thickness T21 of the guide portion 21 is uniform, regardless of position.

However, in an alternative example, the thickness T21 of the guide portion 21 differs according to positions and increases as it moves in a rotational direction of the connection unit 30. In this case, a height of an outer surface of the guide portion 21, i.e., a height of a surface exposed to the outside, is the same irrespective of position, while a height of an inner surface of the guide portion 21, i.e., a height of a surface positioned on the opposite side of the outer surface and positioned inside the insertion recess S20, may be increased or decreased as it moves in the rotational direction of the connection unit 30.

A minimum value of the thickness T21 of the guide portion 21 may be smaller than a thickness H311 of a first portion of the connection unit 30 and a maximum value thereof may be greater than or equal to the thickness H311 of the first portion.

The width W21 of the guide portion 21 is determined according to a protruding length of the protrusion 32 of the connection unit 30.

Thus, in a state in which the connection unit 30 is inserted into the coupling hole H30, when the connection unit 30 rotates at about 90 degrees in the corresponding direction (e.g., toward the fixing unit 22), the protrusion 32 of the connection portion 30 rotates toward the fixing portion 22 in the extending direction of the guide portion 21, while in contact with the corresponding surface of the guide portion 21.

Since the protrusion 32 is positioned on the corresponding surface of the guide portion 21, a space 21, in which the protrusion 32 is positioned and rotates, is positioned above or below the guide portion 21. Here, in case where the guide portion 21 is configured as a sloped surface increased in height toward the fixing portion 23, the connection unit 30 may be more easily inserted and released (or decoupled or removed).

That is, at an initial stage in which the connection unit 30 is inserted into the corresponding coupling hole H20, i.e., before a rotational operation is performed, the connection unit 30 rotates, with a portion thereof protruding, along the ascent guide portion so as to be inserted into the insertion recess S20.

Conversely, when the connection unit 30 is rotated using a corresponding wrench, or the like, in a direction opposite to the direction of coupling of the connection unit 30, the connection unit 30 may rotate in a descending direction along the guide portion 21 and protrude from a lower surface or an upper surface of the point body 201 by a difference in thickness between a maximum value and a minimum value.

Accordingly, an operator may pull the connection unit 30 from the coupling hole H20 using the connection unit 30 drawn to the outside to release the connected state of the tooth point 20 and the tooth adapter 10.

The fixing portion 22 is located on the support portion 24 positioned on the lower surface or the upper surface of the point body 201 and has a ring shape of "⊏" with one side thereof open (i.e., a channel shape). The buffer portion 23 is inserted through the open side, and the fixing portion 22 is positioned to surround the buffer portion 23.

Here, a longer axis of fixing portion 22 is positioned in an extending direction of the support portion 24 extending along an inner surface of the point body 201.

Figure 6:
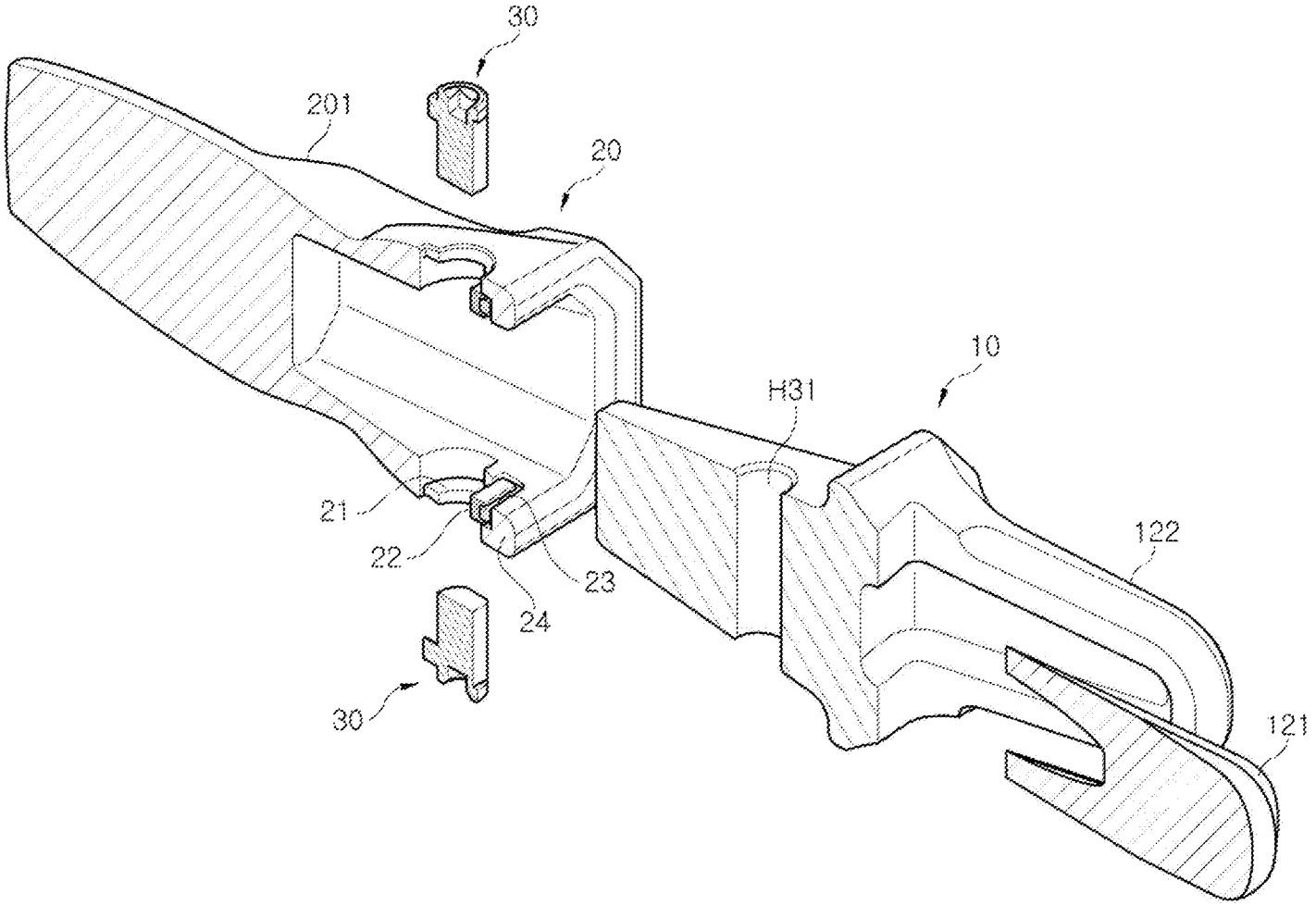
FIG. 6 is a cross-sectional view of the bucket tooth of the excavator illustrated in FIG. 2.

Portions of the fixing portion 22, i.e., portions of a longer axis portion and a shorter axis portion, protrude outwards to the outside of the support portion 24 as illustrated in FIG. 6.

In this example, the fixing portion 22 may be formed of a metal.

Figure 7:
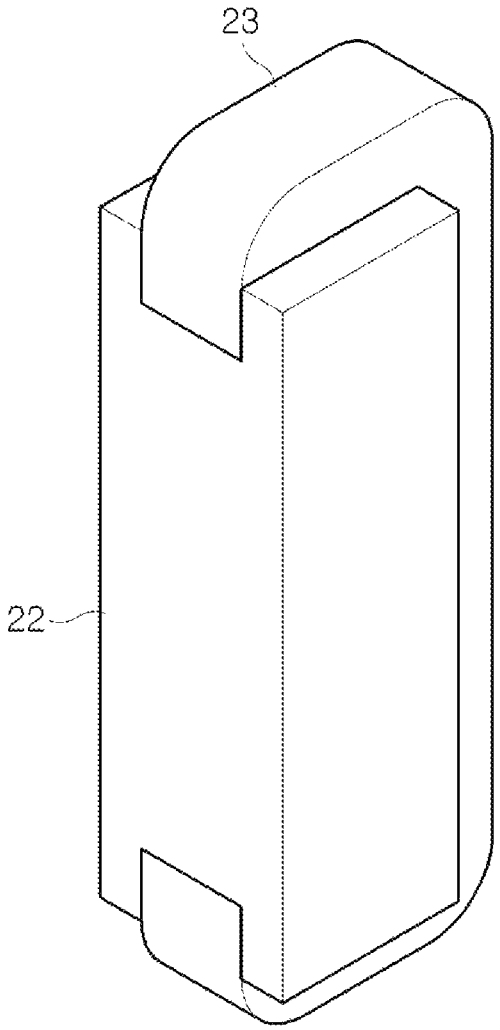
FIG. 7 is a perspective view of a combination of a fixing portion and a buffer portion in a bucket tooth of an excavator according to an embodiment of the present disclosure.

The buffer portion 23 is also located on the support portion 24 and has a rectangular parallelepiped shape. The buffer portion 23 is inserted into an inner hollow space of the fixing portion 22 and is stably fixed to the fixing portion 22 so as to be positioned on the supporting portion 24 (See FIG. 7).

The buffer portion 23 is positioned in close contact between the inner surface of the point body 201 and the fixing part 22 and is in contact with the surface of the fixing portion 22 and the inner surface of the point body 201.

The buffer portion 23 is formed of an elastic material such as an elastomer having elasticity such as rubber or silicon.

Thus, when the connection unit 30 is inserted into the coupling hole H20, the fixing portion 22 is pushed toward the buffer portion 23 according to the insertion operation of the connection unit 30 and the buffer portion 23 is compressed by the pushing operation of the fixing portion 22, and accordingly, the fixing portion 22 is moved toward the buffer portion 23.

As the fixing portion 22 protruding out of the support portion 24 moves toward the buffer portion 23 of the support portion 24 according to the positional movement operation of the fixing portion 22, the connection unit 30 may be easily inserted into the coupling hole H20 without being disturbed by the protruding portion of the fixing portion 22.

Here, the fixing portion 22 may be formed of a metal, which is the same material as that of the connection unit 30 in contact therewith, whereby the insertion and release operations with respect to the coupling hole H20 are facilitated and wear due to contact with the connection unit 30 may be reduced.

When the coupling to the coupling hole H20 is completed, close contact of the connection unit 30 is increased due to a restoring function of the buffer portion 23.

Since the substantially rectangular fixing portion 22 and the buffer portion 23 are located in the coupling hole H20 as described above, the space S22 in which the fixing portion 22 and the buffer portion 23 are located is limited, and blocking portions P21 and P22 limiting the space S22 protrude toward the insertion recess S20 from an upper surface or a lower surface of the point body 201 allowing the fixing portion 22 and the buffer portion 23 to be stably positioned in the space S22.

Here, the blocking portion P21 is positioned between the guide portion 21 and the support portion 24, and the protrusion 32 of the connection unit 30 rotates until it comes into contact with the blocking portion P21, and thus, a rotational range of the protrusion 32 is limited.

The connection unit 30 is inserted into the pair of coupling holes H20 and the pair of through holes H13 when the insertion portion 13 is inserted into the insertion recess S20, to couple the tooth point to the tooth adapter 10. Thus, the pair of coupling holes H20 are positioned at corresponding positions of the upper surface and the lower surface of the tooth point 20 overlapping the through holes when the insertion portion 13 is inserted into the insertion recess S20.

The connection unit 30 may be formed of a metal, such as stainless steel, having good durability such as water resistance and wear resistance such as stainless.

The pair of coupling holes H20 have the same shape and size.

A structure of the coupling holes H20 will be described in detail below.

Figure 8A:
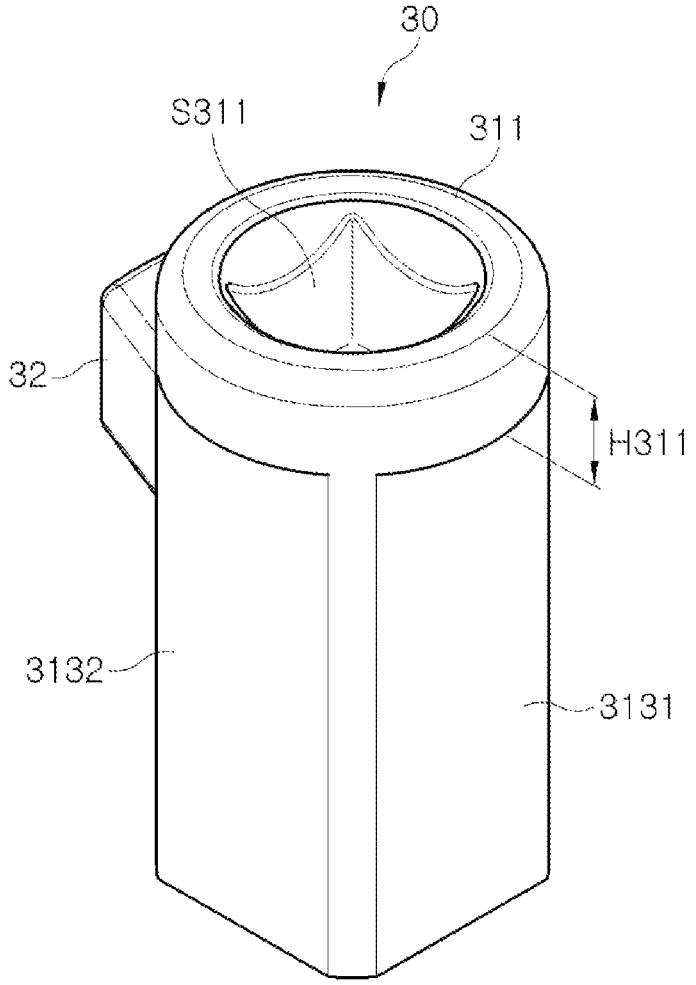
FIGS. 8A and 8B are perspective views of connection units of FIG. 1, respectively, viewed in different directions.

As illustrated in FIGS. 8A and 7B, the pair of connection units 30 inserted respectively inserted into the coupling holes H20 have a column shape inserted into the corresponding coupling holes H20.

More specifically, the connection unit 30 has a unit body 31 and a protrusion 32 protruding outwards from the unit body 31.

The unit body 31 has an upper surface 311 having a circular planar shape, a lower surface 312 positioned on the opposite side of the upper surface 311 and having a planar shape including linear three sides and one curved side, and a side surface 313 extending between the upper surface 311 and the lower surface 312 and having a predetermined length.

The upper surface 311 has a square recess S311, as an empty space, positioned at a middle portion and having a square planar shape. Here, the square recess S311 has a predetermined depth.

The square recess S311 is a portion into which a device such as a square wrench is inserted when the connection unit 30 is to be inserted into the coupling hole H20. Here, an operator may insert the corresponding device into the square recess S311, strike a head portion of the corresponding device with a hammer, or the like, to insert the connection unit 30 into the corresponding coupling hole H20, and subsequently rotate the connection unit 30 in a predetermined direction, thus performing the operation of inserting and coupling to the corresponding coupling hole H20.

Thus, since a cross-sectional shape of the recess S311 has an angulated shape, such as a square shape, or the like, a rotational operation in the corresponding direction may be easily performed.

However, the cross-sectional shape of the recess S311 is not limited to the square shape but may be a polygon such as a hexagon, or the like, depending on the type of equipment in use, and at least one surface thereof may be a curved surface.

The side surface 313 of the connection unit 30 has first to third flat surface portions 3131 to 3133 cut from the lower surface 312 to the upper surface 311 to be flat and a curved portion 3134 positioned between the first and third flat surface portions 3131 and 3133.

Here, the first to third flat surface portions 3131 to 3133 are sequentially positioned adjacent to each other and positioned up to a predetermined distance from the lower surface 312. Accordingly, a circular portion having a circular planar shape is provided because the first to third flat surface portions 3131 to 3133 are not present from the upper surface 311 to the lower surface 312 in the side surface 313.

In this example, an angle formed by two adjacent flat surface portions may be approximately 90 degrees.

Further, a curved surface may be formed between two adjacent flat surface portions.

Thus, the side surface 313 includes the first portion (i.e., the circular portion) positioned in an upper portion adjacent to the upper surface 311 and curved in every portion and a second portion including the first to third flat surface portions 3131 to 3133 and the curved portion 3134.

As described above, the planar shape of the first portion is circular shape, and the planar shape of the second portion has three rectilinear portions sequentially connected to each other and one curved portion. Here, a portion between two rectilinear portions adjacent to each other in the second portion may also be configured as curved portion.

Thus, an engagement protrusion P311, which is a lower surface of the exposed first portion, is positioned between the second portion where the first to third flat surface portions 3131 to 3133 are positioned and the first portion.

Due to the first to third flat surface portions 3131 to 3133 and the curved surface portion 3134, a planar shape of the lower surface 312 connected to the side surface 313 has three rectilinear portions and one curved portion as described above.

The protrusion 32 protrudes outwards from the curved surface portion 3134 of the side surface 313 and a height of an upper end surface of the protrusion 32 may be equal to a height of the lower surface of the first portion, i.e., a position of the protrusion P311.

The protrusion 32 serves as a fixing latch for stably positioning the connection unit 30 in the coupling hole H20 after the connection unit 30 is inserted into the coupling hole H20.

Figure 11A:
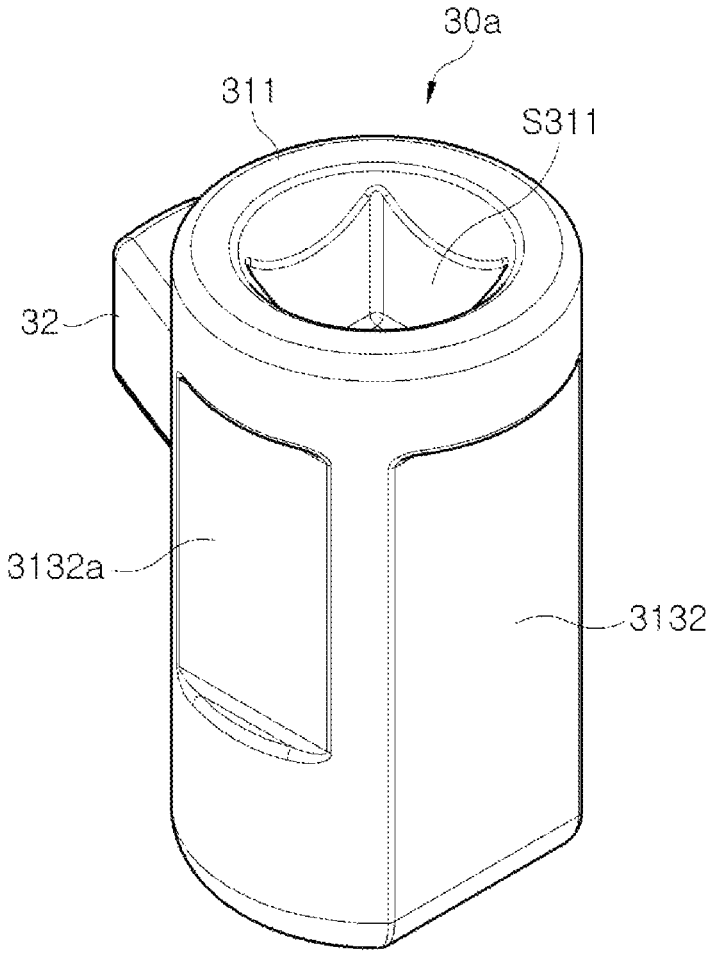
FIGS. 11A and 11B are perspective views of another example of the connection unit of FIG. 1, respectively, viewed in different directions.
Figure 11B:
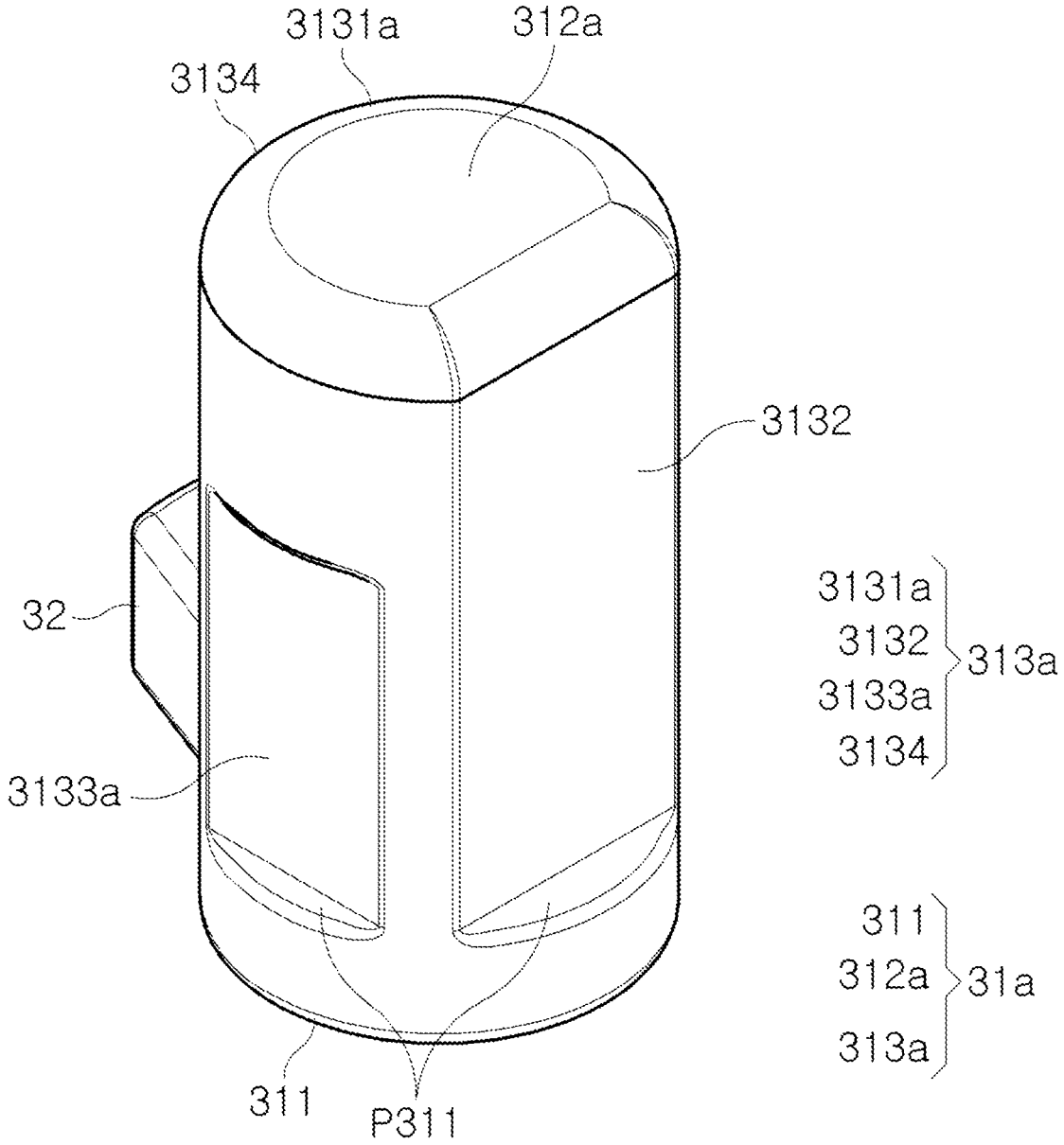

However, the connection unit may have a structure different from that illustrated in FIGS. 11A and 11B.

Figure 8B:
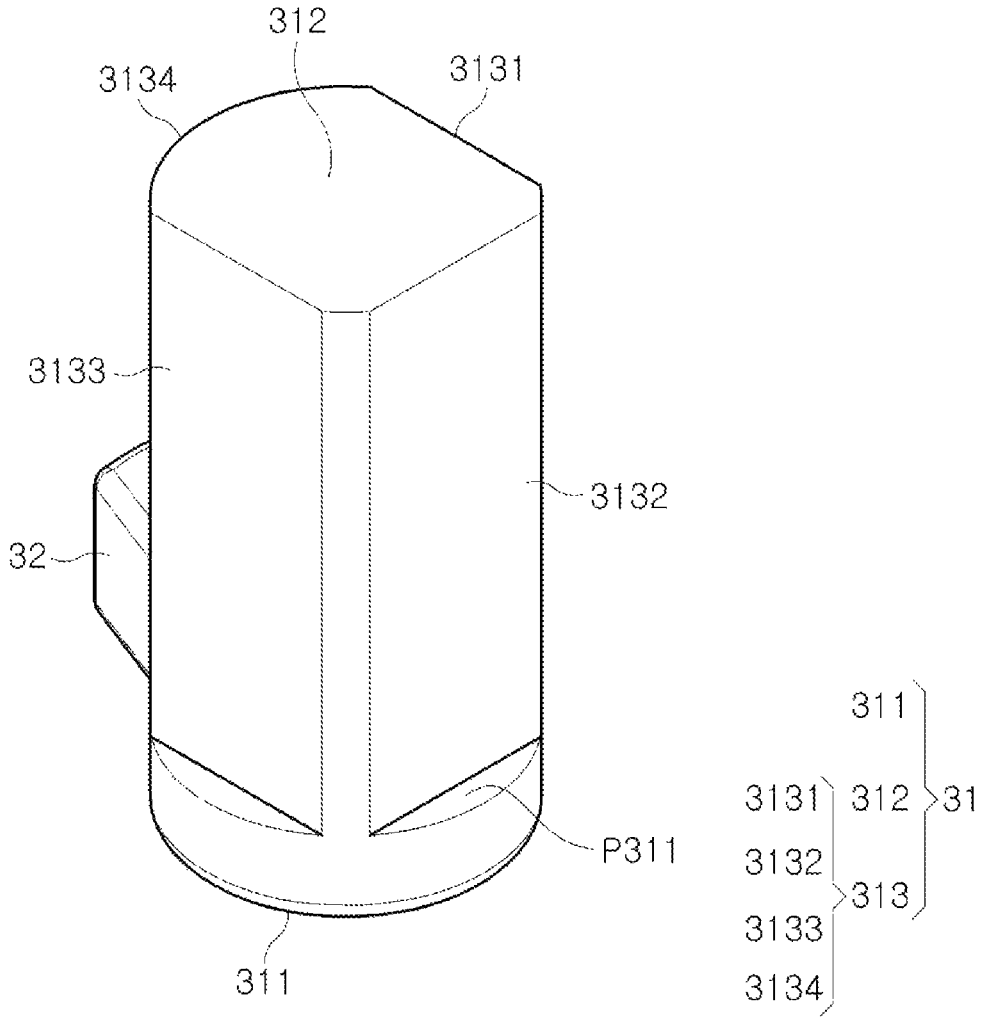
Figure 9:
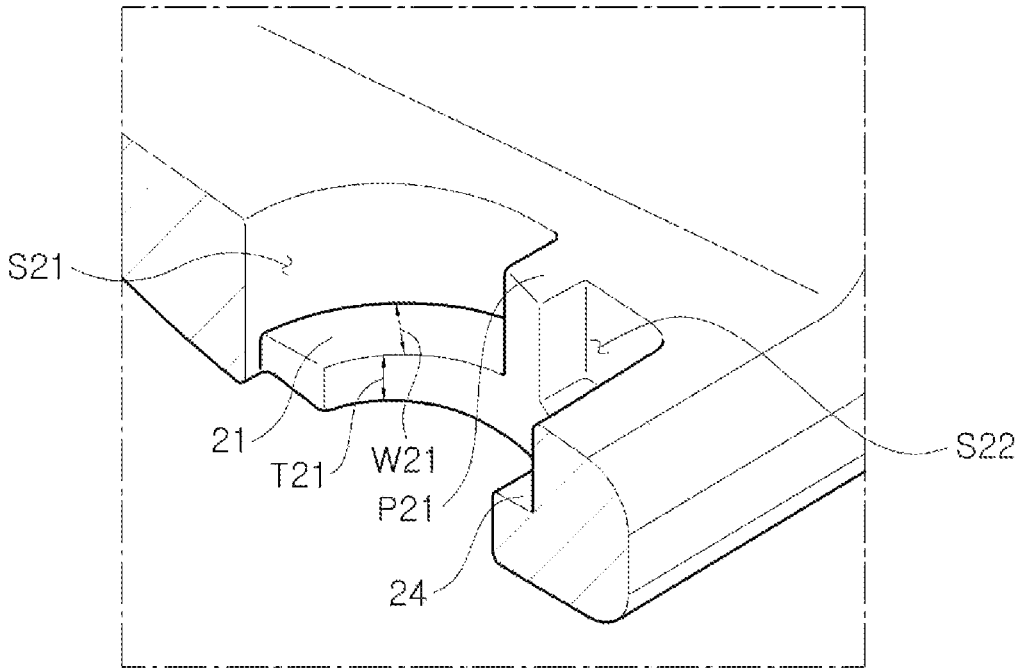
FIG. 9 is a partial enlarged view of a coupling hole of FIG. 1.

The connection unit 30*a* illustrated in FIGS. 11A and 11B has the same structure as that of the connection unit 30 illustrated in FIGS. 8A and 8B, except for the side surface portion 313 to be compared.

Both the connection unit 30 illustrated in FIGS. 8A and 8B and the connection unit 30*a* illustrated in FIGS. 11A and 11B have unit bodies 31 and 31*a* and the protrusion 32, and the unit bodies 31 and 31*a* have the upper surface 311, the lower surface 313, and side surfaces 313 and 313*a* each having a circular planar shape.

However, the side surface portion 313 of the unit body 31 illustrated in FIGS. 8A and 8B has the curved surface portion 3134 positioned on a surface on which the protrusion 32 is formed and the other three flat surface portions 3131 to 3133. Here, the three flat surface portions 3131 to 3133 are cut surfaces cut from the lower surface 312 to the circular portion. Thus, all the portions from the circular portion to the lower surface 312 are cut to form the flat surface portions 3131 to 3133.

In contrast, the side surface portion 313*a* of the unit body 31*a* illustrated in FIGS. 11A and 11B also has a curved surface portion 3134 and three flat surface portions 3131*a*, 3132, and 3133*a*, but cut lengths of the three flat surface portions 3131*a*, 3132, and 3133*a* are different from the case of the unit body 31.

That is, as illustrated, the flat surface portion 3132 located on the opposite side of the protrusion 32 has a cut shape entirely cut from the circular portion to the lower surface 312 as illustrated in FIGS. 8A and 8B, while the other two flat surface portions 3131*a* and 3133*a* are cut surfaces which are not cut to the lower surface 312 but are cut to a portion before the lower surface 312. That is, the cut lengths thereof are shorter.

Accordingly, a curved surface portion, rather than a flat surface, is present between the lower surface 312 and each of the flat surface portions 3131*a* and 3133*a*, not a flat surface.

Except for the structural difference of the unit body 31*a*, the connection unit 30*a* of this example operates in the same manner as that of the connection unit 30 illustrated in FIGS. 8A and 8B to couple the tooth adapter 10 and the tooth pointer 20 and release a combined state.

In order to couple the bucket tooth of the excavator having such a structure, first, the insertion portion 13 of the tooth adapter 10 is inserted into the insertion recess S20 of the tooth point 20.

Through the insertion operation, the positions of the through holes H13 located in the insertion portion 13 and the coupling holes H20 of the tooth point 20 are aligned with each other.

Figure 10A:
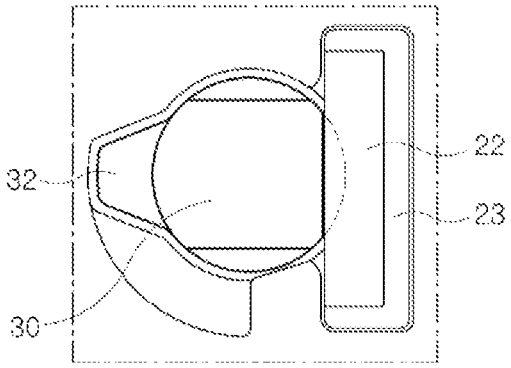
Figure 10B:
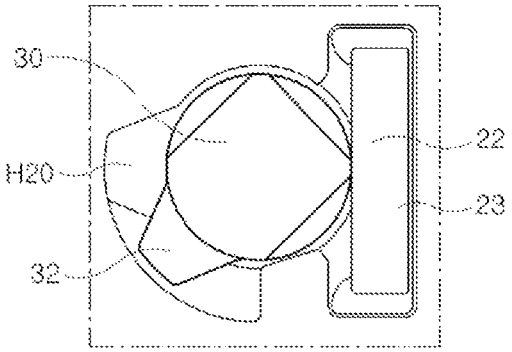
Figure 10C:
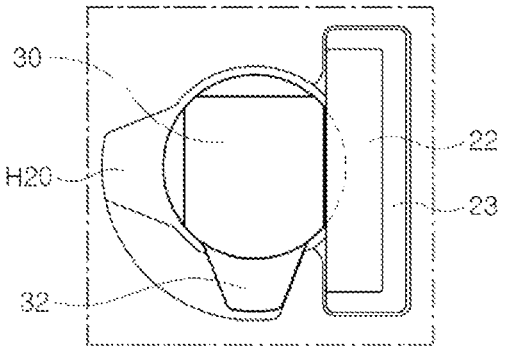

Thereafter, the connection units 30 are inserted into the corresponding coupling holes H20 and are subsequently rotated in the corresponding direction so as to be inserted into the coupling holes H20 (FIGS. 10A to 10C).

Here, as described above, the exposed portion of the connection unit 30 is inserted into the coupling hole H20 by the guide portion 21 as a sloped surface, and here, the insertion operation of the connection unit 30 is facilitated by the buffer portion 23 and a coupling force of the connection unit 30 increases in the coupling hole H20 so that the coupled connection unit 30 is prevented from being pulled out by itself (See FIG. 10C).

In this manner, when the two connection units 30 are inserted in the mutually opposite directions to couple the tooth adapter 10 and the tooth point 20, the two connection units 30 positioned in the mutually opposite directions are spaced apart from each other in the recess S20, rather than being in contact with each other. Accordingly, an empty space is located between the two connection units 30.

Therefore, the coupling operation may be performed more easily and conveniently than when the tooth point 20 is coupled to the tooth adapter 10 using one connection unit, and manufacturing cost of the connection unit is also reduced.

Further, since the two connection units 30 inserted in the opposite directions (e.g., the downward direction and the upward direction) have the same structure, the insertion operation of the connection units 30 having one structure is performed, regardless of insertion direction.

Therefore, compared with connection units having different structures according to insertion directions, the connection units 30 may be manufactured using a single mold frame, and thus, manufacturing cost for manufacturing two mold frames may be reduced.

Further, since there is no need to distinguish between the connection units 30 according to the insertion directions, an operation time may be significantly reduced when the connection operation of the connection unit 30 is performed.

In order to release the connection unit 30 insertedly positioned in the coupling hole H20, the connection unit 30 is rotated in the direction opposite to that of the coupling operation, and here, the connection unit 30 is lowered or lifted along the sloped surface according to the rotational operation and a portion of the connection unit 30 protrudes to the outside. Accordingly, the operator may easily remove the connection unit 30 from the coupling hole H20 using the outwardly protruding portion (See FIG. 10A).

The embodiment of the bucket tooth of the excavator of the present disclosure has been described. The present disclosure is not limited to the above-described embodiment and the accompanying drawings, and various modifications and changes may be made in view of the person skilled in the art to which the present disclosure pertains. The scope of the invention should, therefore, be determined by equivalents to the claims, as well as by the claims of the present disclosure.

What is claimed is:

1. A tooth for a bucket of an excavator, the tooth comprising:

a tooth point having a hollow insertion recess and having a pair of coupling holes positioned to face each other on opposite sides;

a tooth adaptor having an insertion portion configured to be inserted into the hollow insertion recess and having a through hole passing through the insertion portion along a thickness direction of the insertion portion; and a pair of connection units respectively configured to be inserted into the pair of coupling holes and the through hole, and respectively having a unit body and a protrusion protruding from the unit body, wherein the tooth point includes:

a guide portion positioned in each of the pair of coupling holes to guide a rotational operation of the protrusion of the respective connection unit;

a fixing portion configured for fixing a position of the respective connection unit;

a buffer portion made of an elastic material positioned between the fixing portion and an inner surface of the tooth point and surrounding the fixing portion; and a support on which the fixing portion and the buffer portion are positioned, wherein the fixing portion is made of a harder material than the elastic material of the buffer portion.

2. The tooth of claim 1, wherein the guide portion has a same thickness, regardless of position.

3. The tooth of claim 1, wherein the guide portion is increased in thickness toward the support.

4. The tooth of claim 1, wherein the fixing portion includes a portion protruding to an outside of the support.

5. The tooth of claim 1, wherein the fixing portion has a rectangular parallelepiped shape, the buffer portion has a coupling recess, and the fixing portion is surrounded by the coupling recess of the buffer portion.

6. A tooth for a bucket of an excavator, the tooth comprising:

a tooth point having a hollow insertion recess and having a pair of coupling holes positioned to face each other on opposite sides; and a pair of connection units respectively configured to be inserted into the pair of coupling holes, and respectively having a unit body and a protrusion protruding from the unit body, wherein the tooth point includes:

a guide portion positioned in each of the pair of coupling holes to guide a rotational operation of the protrusion of the respective connection unit;

a fixing portion configured for fixing a position of the respective connection unit;

a buffer portion of an elastic material positioned between the fixing portion and an inner surface of the tooth point and surrounding the fixing portion; and a support on which the fixing portion and the buffer portion are positioned, wherein each of the pair of connection units includes:

an upper surface having a circular planar shape;

a side surface having first to third flat surface portions positioned below the upper surface and a curved portion positioned between two adjacent flat surface portions and having the protrusion; and a lower surface connected to the side surface.

7. The tooth of claim 6, wherein the side surface further includes a circular portion between the upper surface and the second and third flat surface portions.

8. The tooth of claim 7, wherein the first to third flat surface portions are extended from the upper surface to the lower surface.

9. The tooth of claim 7, wherein two of the first to third flat surface portions are extended from the upper surface to the lower surface and the other remaining flat surface portion is extended from the upper surface to a portion apart from the lower surface.

10. The tooth of claim 6, wherein the pair of connection units having inserted into the pair of coupling holes are spaced apart from each other in the insertion recess.

11. The tooth of claim 6, wherein an upper surface of each of the connection units includes a polygonal recess.

12. A tooth for a bucket of an excavator, the tooth comprising:

a tooth point having a hollow insertion recess and having a pair of coupling holes positioned to face each other on opposite sides; and a pair of connection units respectively configured to be inserted into the pair of coupling holes, and respectively having a unit body and a protrusion protruding from the unit body, wherein the tooth point includes:

a guide portion positioned in each of the pair of coupling holes to guide a rotational operation of the protrusion of the respective connection unit;

a fixing portion configured for fixing a position of the respective connection unit;

a buffer portion made of an elastic material positioned between the fixing portion and an inner surface of the tooth point and surrounding the fixing portion; and a support on which the fixing portion and the buffer portion are positioned, wherein each of the pair of connection units includes a side surface having first to third flat surface portions, and wherein, when each of the pair of connection units is inserted into each of the pair of coupling holes, one of the first to third flat surface portions comes into contact with the fixing portion, and when rotation of the inserted connection unit is completed, another of the first to third flat surface portions comes into contact with the fixing portion.

* * * * *